United States Patent [19]

Asplund

[11] 4,199,114

[45] Apr. 22, 1980

[54] APPARATUS FOR PRODUCING DISINTEGRATED MATERIAL, PREFERABLY PULP

[76] Inventor: Arne Asplund, Tykövägen 20, Lidingö 3, Sweden

[21] Appl. No.: 887,537

[22] Filed: Mar. 17, 1978

[51] Int. Cl.[2] ..... B02C 18/18

[52] U.S. Cl. ..... 241/246; 241/259.1; 241/261

[58] Field of Search ..... 241/27, 28, 30, 188 R, 241/259.1, 261.1, 244, 261, 260, 260.1, 246

[56] References Cited

U.S. PATENT DOCUMENTS

| | | | |
|---|---|---|---|
| Re. 29,053 | 11/1976 | Cumpston, Jr. | 241/260 |
| 2,008,892 | 7/1935 | Asplund | 241/28 X |
| 2,216,612 | 10/1940 | Dimm et al. | 241/259.1 X |
| 3,547,356 | 12/1970 | Asplund | 241/28 |

*Primary Examiner*—Mark Rosenbaum
*Attorney, Agent, or Firm*—Eric Y. Munson

[57] ABSTRACT

Method and apparatus for controlling the refining of fibrous lignocellulose pulp material in which the pulp stock or grist is conveyed into a cylindrical stationary drum and propelled therein in a linear direction in a pulsating fashion by a co-axial rotor comprising a plurality of impellers which attack the grist in a wedging action as it is compacted by the centrifugal force of rotation and pushed ahead of the leading edges of the impellers and thus inducing in the grist internal frictional shear forces while it is forced through a gap defined between the terminal edges of the impellers and a series of shear members arranged axially along the interior surface of the drum. The impellers are detachably and adjustably anchored in slots in the peripheral wall of the drum to vary the gap clearance. A plurality of adjustable plow members for enhancing the linear flow of the grist through the drum may be additionally mounted in the peripheral wall of the drum to extend radially inwards to engage accommodating slots in the impellers to thereby regulate the amount of grist pushed ahead during each revolution of the impellers and to control the centrifugal force exerted on the grist.

2 Claims, 6 Drawing Figures

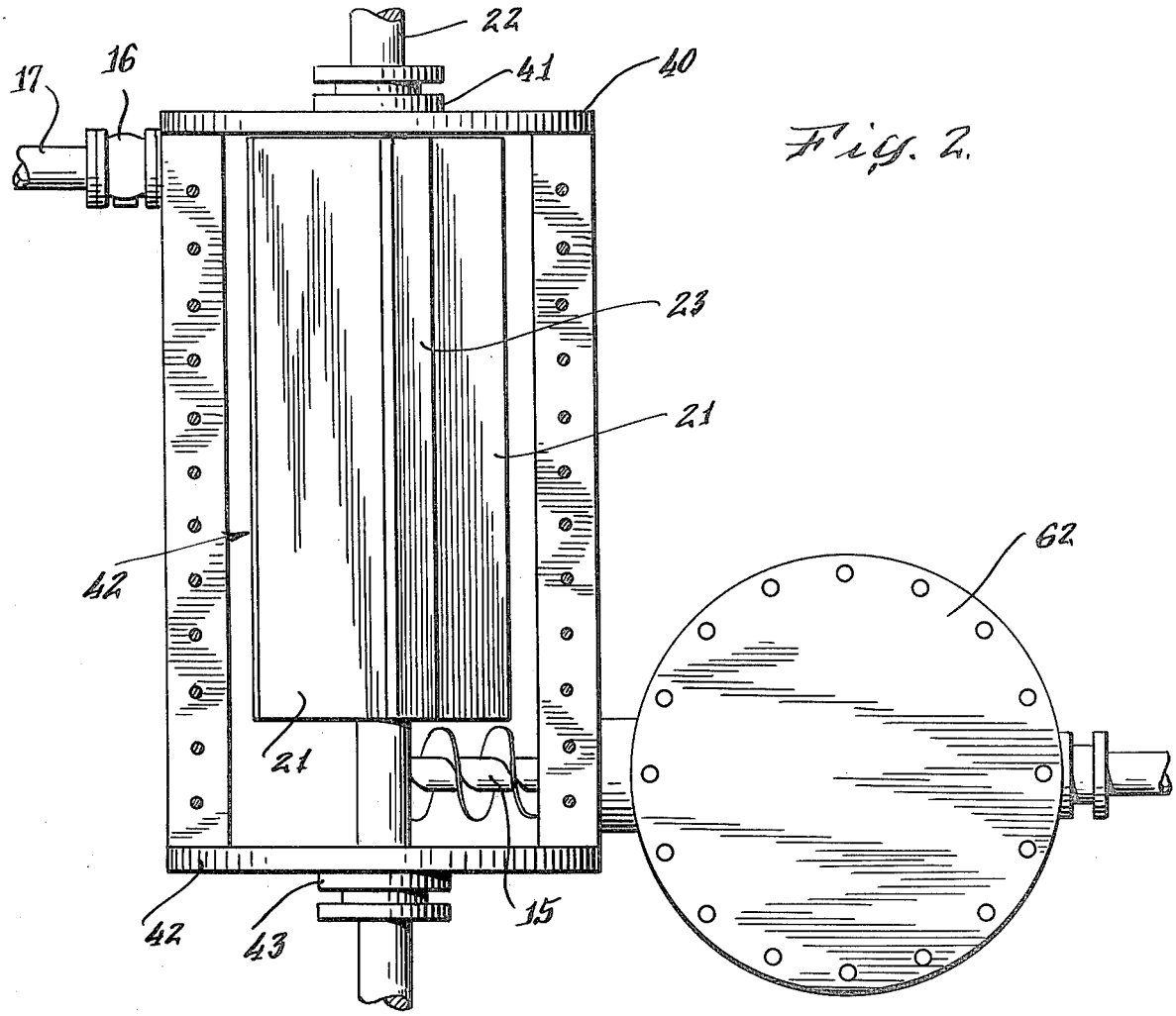
Fig. 2.
Fig. 1.
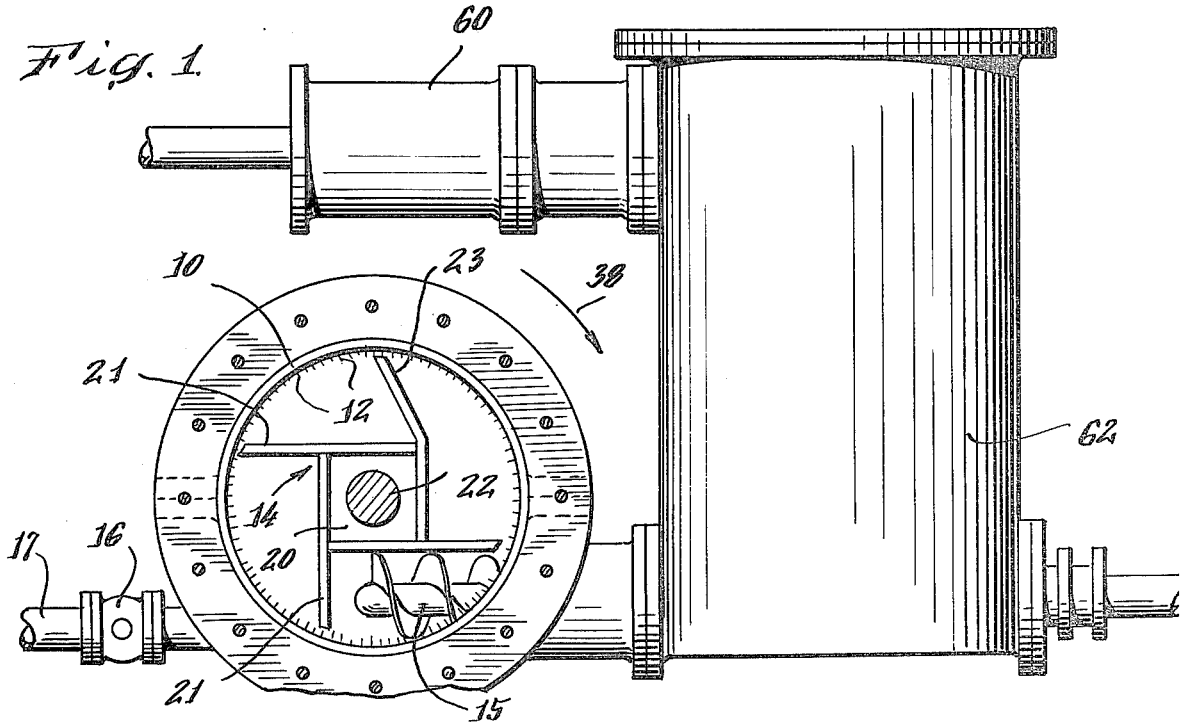

APPARATUS FOR PRODUCING DISINTEGRATED MATERIAL, PREFERABLY PULP

BACKGROUND OF THE INVENTION

My invention relates to a method and machinery for the production of pulp and for postrefining of such pulp from fibrous ligno-cellulose raw materials for the production of paper, paperboard, fiberboard, formed products for shipping containers, dry formed board and many other useful products. The invention can also in certain cases be used for dispersion and pulverizing of ceramics and other products, which for its further manufacture has to be kneaded or mixed with other additives. The material under processing will in the following be called "grist". The invention comprises a process where the material is compressed and accelerated within a closed, or nearly closed, cylinder, hereinafter called the "drum" by a rotary member concentric with the cylinder and equipped with blades, hereinafter called "impellers", compressing by centrifugal force the grist in a radial direction against the walls of the drum and the refining members, hereinafter called "staves" located on the inside wall of the cylinder or drum. The staves are equipped with edges perpendicular to the path of the accelerated grist, which moves between the rotating impellers and the stationary edges, thus creating within the grist planes of frictional shear forces.

According to the U.S. Pat. No. 3,547,536 granted the applicant a similar method is disclosed where the inside wall of the cylinder in the axial direction is equipped with grooves of limited radial extent where small quantities of the grist is retarded whereas at the same time the impellers keep the main part of the grist in rapid rotation. The layers of grist moved by the impellers and the layers of grist retarded by the grooves on the inside of the cylinder are refined along the plane of shear created between the two layers of grist. The obstructions formed by the grooves according to the known method are sequentially arranged with gradual slopes in order that the refining action shall be accomplished mainly through the internal friction created between the fibers themselves when they pass through the concentric slot between the impellers and the undulations on the inner wall of the cylinder.

OBJECTS OF THE PRESENT INVENTION

The purpose of the present invention is to further improve the refining action of a refiner working according to the above described principle in order to obtain a more efficient fibrillization and a separation of fibers and fibrillae resulting in a pulp with properties well suited for the manufacture of paper and similar products.

SUMMARY OF THE INVENTION

The aforementioned object is attained mainly through a simultaneous action on the compacted grist by the centrifugal forces creating planes of internal shear when it is subjected to the external forces induced by the edges of the refining members arranged on the inner periphery of the closed cylinder which tend to slice the surface layers of the fibers. A drum designed according the invention can along its inside wall be equipped with axially arranged refining members, suitably with rectangular cross sections, which are made from harder material than the material of the drum and which with their edges cooperate with the impellers to refine the fibers of the grist. These refining members thus have the form of staves along the inside wall of the drum generally only protruding 1 to 2 mm from the wall with a suitable distance from each other of 20 mm or more or less according to the refining effect desired. The surface of the drum between the staves can follow the cylindrical form of the drum or may be formed as slightly deepened grooves as shown on the accompanying drawings. The final refining of the raw material is according the invention accomplished by subjecting the grist to the planes of shear induced within the grist as well as to the slicing action on the fibers created when the body of grist with high velocity moves past the edges of the refining staves or shear members. A refiner according to the invention will have a higher capacity than the previously known design.

The refining effect is created by the retarding action obtained on the flow of grist when it with high velocity moves perpendicularly past the edges of the staves or shear member.

The staves arranged perpendicularly or nearly so on the inner surface of the drum have a powerful retarding effect on the flow of the compacted grist and intensive planes of friction or shear are created because of the great difference in velocity between the fraction of grist retarded by the edges and the part of grist which continues to rotate with the impellers. When one part of the grist is retarded by the edges of the staves and the other part continues to move, the grist will be acted upon not only between the internal planes of friction developed between the stationary and moving portions of the grist but also by direct mechanical action on the grist by the edges of the staves resulting in an intensive and extended separation of the fibers.

The staves on the inside wall of the drum are suitably held in axially milled grooves of such a depth that the terminal edges protrudes somewhat, for instance one or two mm from the inside wall of the drum.

The invention is especially well suited for the preparation of thermomechanical pulp as well as for post refining of paper pulp in general.

The raw material fed into the refiner is accelerated by the impellers of the rotor throwing it against the inside wall of the drum. According to U.S. Pat. No. 3,547,356 it is known to utilize a plow or cam means, which can move the grist axially. The plowing action according to the invention has been improved by extending the plows or cams radially into corresponding slots in the impellers. The axial flow of the grist under processing in the drum is thus facilitated when the stationary plow members extend further into the flow of grist carried by the impellers.

By steering the grist in this manner the amount of grist can be increased or decreased. At a constant rotary speed of the rotor a varying pressure will be exerted by the grist against the staves depending on which amount of compacted grist is allowed to accumulate on the impellers.

The magnitude of the pressure in the refining zone is also dependent upon the angle which the surface of the impellers presents in relation to their direction of rotation. If these surfaces are directed radially the outward force on the grist will be less than when they have a negative angle in relation to the direction of rotation. The effect of the refiner can therefore be adjusted by an exchange of impellers or by changing the angle of inclination of the impellers.

The grist is thus compressed in the wedge-formed space between the inclined impeller 11 and the inside surface 11 of the drum and the highly compacted body of the grist is sliced by the edges of the staves.

The smaller the angle, the higher compression is obtained.

The shearing members or the staves are preferably made from ceramic material e.g. from silicon carbide, which has a great resistance to wear and therefore will longer retain their angle of attack against the grist. At the same time the crystalline properties should favour the retention of the refining properties of their active edge.

Refining bars or shear bars of cobalt bound wolfram carbide can also be used. Further, it is of importance that the edges do not protrude too far from the inner surface of the drum, generally from 1 to 2 mm inwardly in order to efficiently utilize the maximum slicing effect.

The mounting of the staves in their slots makes it possible to remove them and reinsert them in a new position to utilize all four edges before discarding them or renew their refining ability by regrinding the edges.

The geometrical form of the working edges of the staves should on account of the natural wear be 90° with about 1° give in negative direction.

BRIEF DESCRIPTION OF THE DRAWINGS

FIG. 1 is a section along the line I—I in FIG. 2 which shows a view from above of a refiner and feeding device with the upper half of the refiner removed.

In all of the drawings the same numerals have been used for corresponding parts.

DESCRIPTION OF AN EMBODIMENT OF THE INVENTION

Figure 3:
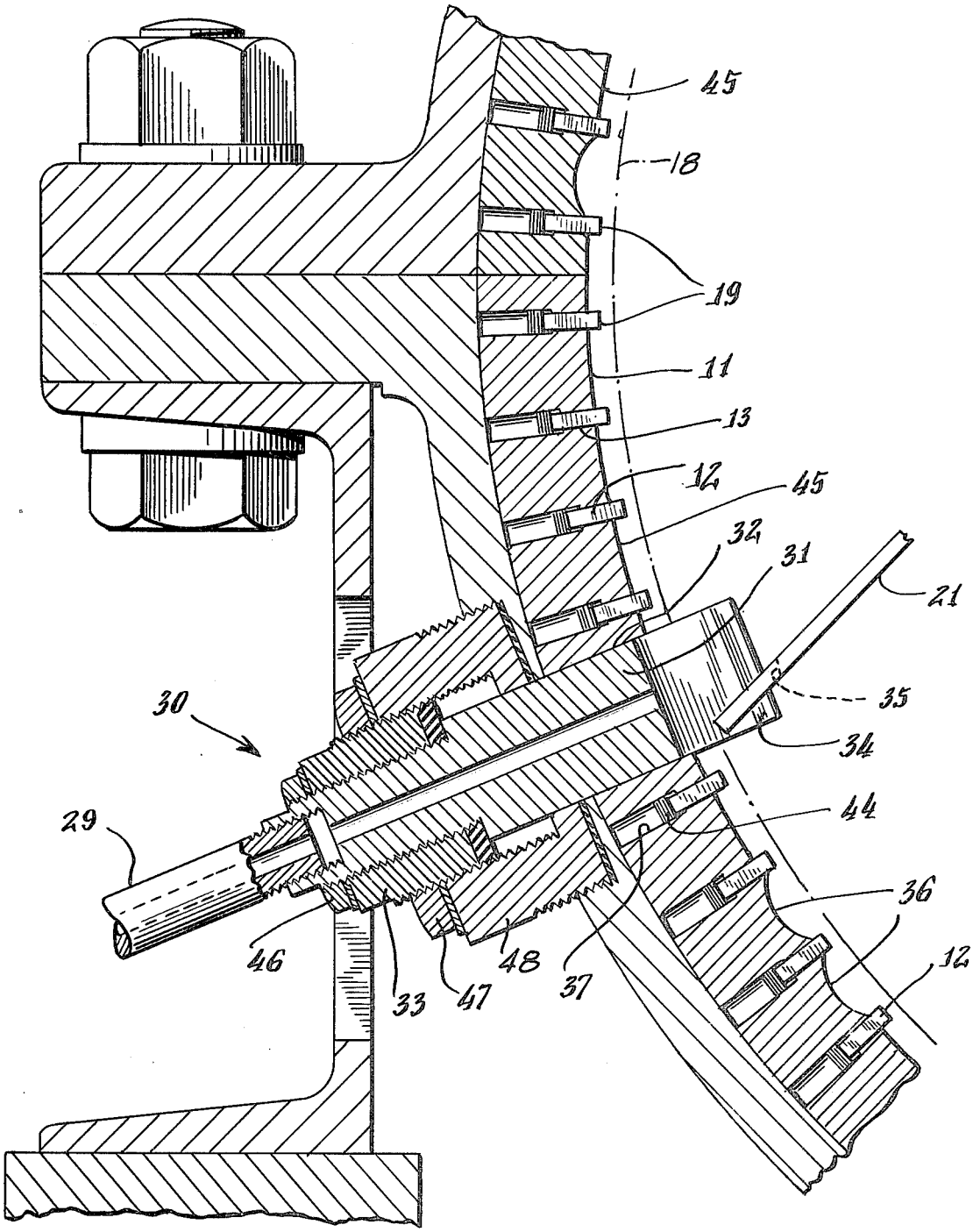
FIG. 3 is shown a cross section of a part of the refiner drum and rotor.
Figure 4:
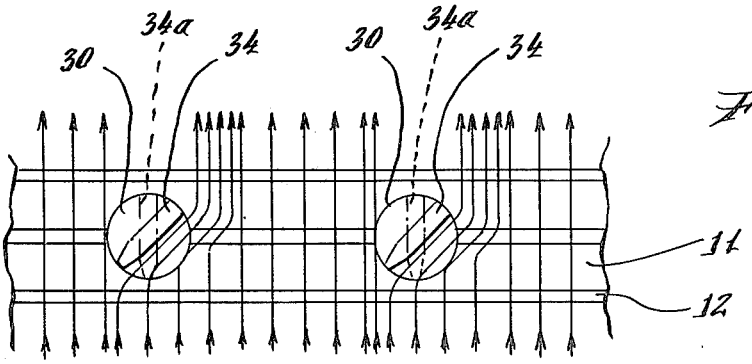
In FIG. 4 is a schematic view showing how two plows regulate the axial flow of the grist through the refiner.

In FIGS. 1 and 2 is shown a side view and a view from above of a refiner intended for industrial use for the production of mechanical refiner pulp or thermomechanical pulp (TMP). The refiner has one rotor 14 with four impellers 21. The drum 10 is equipped with refiner means 12 made from material with a higher wear resistance than the material of the lining of the drum. In FIG. 2 the flange 42 (FIG. 1) has been removed to show the conveyor screw 15 which feeds the preheated chips into the refining zone where they are accelerated by the rotating impellers. The drum 10 of the refiner according to FIG. 1 and FIG. 2 is at both ends closed by flanges 40 and 42 with openings for the shaft 22. The shaft 22 passes through the flange 40 through a packing box 41 and at its other end through the flange 42 through a packing box 43. The refiner can therefore be used for refining at elevated temperatures as in thermomechanical refining of wood.

The refiner is equipped with a preheater 62 where the chips are brought up to the temperature required for TMP refining. The chips are fed into the TMP refiner by the feeder 60 and the finished pulp leaves the refiner through the exhaust valve 16 and pipe 17. The capacity of the refiner is regulated by means of the feeder 60 and the exhaust valve 16. The feeder 60 can be of a continuous screw type preventing steam from escaping from the inside of the drum. An elevated steam pressure can be maintained in the drum by the admission of steam or by the use of the steam developed during the refining process from the moisture present in the grist.

The rotor 14 can be rotated by means of a motor (not shown) by a shaft 22. The impellers 21 on the nave 20 of the rotor are on the drawing four in number, but may be eight or more depending upon the capacity of the refiner. The impellers 21 extend towards the inside surface of the drum where in the embodiment shown, staves or shear members 12 are shown with a rectangular cross section inserted in axially disposed grooves 13 machined into the inside surface 11 of the drum as shown by way of example in FIG. 3. These staves or shear members 12 as well as the impellers 14 cover the whole or practically the whole part of the inside of the drum 10. The grooves 13 follow the contour of the inside wall of the drum and are preferably arranged as diametrically opposite pairs and are therefore passed simultaneously by two likewise diametrically opposite impellers 21. These impellers 21 extend to a limited distance from the staves 12 as is indicated by the broken line 18 in FIG. 3.

The staves 12 are made from a highly wear resistant material as for instance silicon carbide or carborundum and are shown with rectangular cross section. They are with the herein major part of their width sunk into the grooves 13 and extend only one or two mm beyond the inner wall of the drum. The rectangular cross section of the staves may be 3×15 or 4×18 mm. They thus form edges at their free end portions with an angle of approximately 90° relative to one another.

The mode of application of the staves 12 in the slots 13 of the cylinder segments 45 is of importance for the technical and economical functioning of the refiner.

The projection of the operating edge 19 of the staves 12 beyond the inside surface 11 of the drum (FIG. 3) is of great importance for the creation of the frictional shear forces within the moving grist and how the surface of the single fibers will be influenced by the edge. If the depth of the slot is made equal or nearly equal to the width of the stave 12 the chosen projection of the edge 19 is determined by a metal strip 44 introduced at the bottom of the slot. The sides of the staves 12 are thereafter coated with a metal adhering glue and pressed down securely. The stave 12 should be held in place until the glue has set sufficiently. When the refiner is used for the production of thermomechanical pulp the heat resistant properties of the glue has to be considered. The drum can also be equipped with one or more radial holes 37 for each stave along the slots 13, where tools can be used for the removal of the staves 12. The exchange of the staves 12 is thereby facilitated and the unused edges of the staves can be successively utilized. The staves 12 can also be resharpened.

The depth of the slots should preferably be such that a working distance of the edge 19 beyond the surface 11 ranging from 0.5 up to 2 or 3 mm can be selected. Under special conditions a greater distance may be considered but should not exceed 10 mm as then the uniform flow and exchange of material in the space walled in by the staves may be disturbed.

The length of the period of service of the functioning edge of the refiner staves depends upon the abrasive action to which they are subjected and when staves of metallic origin are used also upon the chemical action by certain components of the grist. The edge will be rounded off also by uncontaminated raw material, an action which can to a very high degree be accelerated by mineral contaminants. I have found that the selection of staves made from mineral material is important and that for certain types of refining the best results are obtained with materials which do not easily take polish but which develop a coarse surface when worn.

The refiner can preferably be equipped with implements 30 for maintaining and regulating the axial flow of the grist through the refiner from the feeder to the outlet. A number of such axial flow feeders is shown in FIGS. 3–6. Each comprises a cylindrical plug 31 which can be rotated in a hole 32 in the drum 10. The plug 31 can be turned from the outside and locked in desired position by the locknut 33 held by means of lock nuts 46, 47 in a sleeve 48 for the plug 31. The plug 31 also has a connection 29 for addition of water, chemicals or the like through an axial channel in the plug 31.

Figure 5:
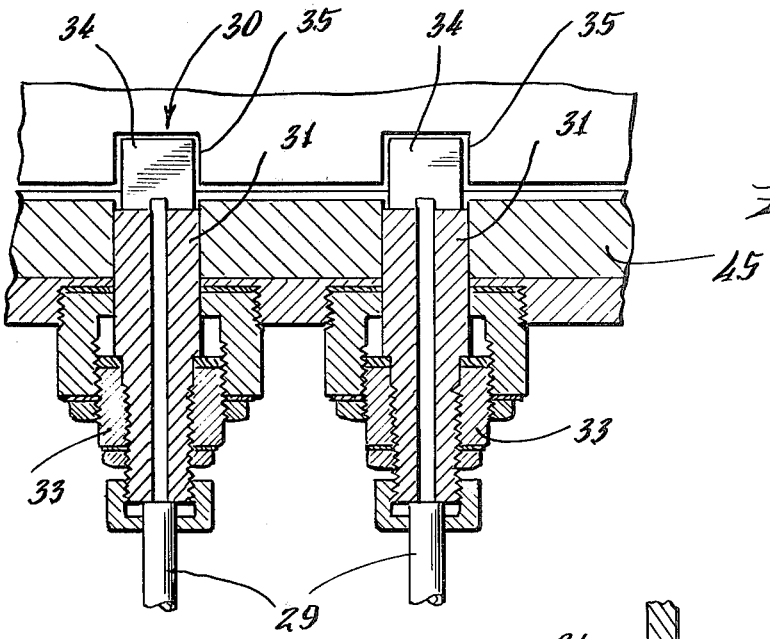
FIG. 5 is a cross section through part of the refiner drum and the two plows shown in FIG. 4, seen in the transverse direction of the refiner.
Figure 6:
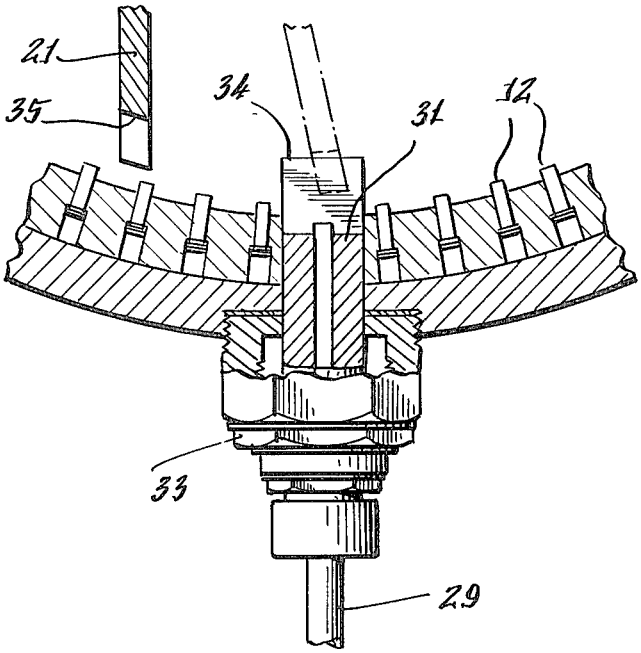
FIG. 6 is a cross section of the refiner drum and a plow seen in the longitudinal direction of the refiner.

The plug has on its interior end a plow 34 extending inwardly in radial direction passing through the space between the staves 12 and the impellers 21. In the impellers are made corresponding openings 35 to allow the impellers to pass (FIG. 5). By turning the plow 34 from a true radial position 34*a* indicated by broken lines in FIG. 4 to a desired angle, the axial flow of grist through the refiner can be adjusted to maintain a desired refining action of the refiner.

The plug 31 with its plow 34 can also be moved by the nut 33 in radial direction and locked in its position by the locknut 46 to increase or decrease the amount of grist moved at each passage of the impellers 21 past the plow 34.

By the angular and radial positioning of the plug 31 and the plow 34 the amount of grist carried by the impellers 21 can be regulated and thereby the pressure created by the centrifugal force on the grist against the refining edges 19 can also be changed within wide limits.

The faster the grist is moved axially through the refiner the less weight of grist is carried by the impellers 21 per unit of time. The pressure against the edges will then decrease.

As is indicated in FIG. 3 the inside surface 11 of the drum 10 can be either purely cylindrical or be given suitably profiled grooves 36 between each pair of staves 12. The grooves may be given a smooth streamline contour.

When rotating in the direction indicated by the arrow 38 (FIG. 1) the grist will be carried by the separate impellers 21 in smaller or greater quantities depending mainly on the quantity of grist fed to the refiner and the adjustment of the plows 34. As can be seen from FIG. 1 and FIG. 3 the angle between the impeller 21 and plow 34 is negative or a little less than 90°. A greater quantity carried by the impellers creates a higher pressure of the grist against the edges of the staves 12 resulting in a more active refining action.

To increase the flow of grist towards the outlet the diameter of the drum may be enlarged to a conicity of 1:100 or even more to obtain the desired flow.

After entering the refiner, the grist is accelerated by the impellers 21 and by centrifugal forces compacted in rotating flow along the inside surface of the drum, where grist may here move with a velocity of from 20 to 60 m per second or more depending upon the inside diameter of the drum and the speed of the rotor. When the body of the flowing grist is retarded by the edges of the staves, intensive refining forces are developed which act on the fibers and the simultaneously developed internal shearing forces create fiber-to-fiber adhesion in the body of grist.

The kinetic energy of the parts of the grist brought to a full stop will be transformed into heat, thus increasing the temperature of the grist and causing a part of its water content to evaporate. Depending upon the moisture content of the chips water may therefore have to be added to the grist to prevent a harmful decrease in moisture ratio.

It has been observed that in the space along the surface between the staves no harmful retention of fiber pulp will take place. The flow of grist is sufficient to prevent stagnant pulp to accumulate.

By microscopic observations of pulp from spruce wood refined for production of news print it has been established that the refining action on the primary and secondary layers of the tracheids is even more advantageous than the effect obtained by conventional disc refiners.

Stroboscopic observations made of the flow of grist inside the refiner under operation show that the particles of the grist after having been retarded by the edges of the stave lose their speed and after having passed across the edges are collected on the surface of the next impeller where it accumulates the weight necessary to build up the desired refining pressure as it is again shaved off against a following stationary edge.

The accumulation of grist on the impellers is fully at random and a large portion of the fibers have lost most of the stiffness characteristic for conventional mechanical pulp.

What I claim is:

1. In a drum refiner for refining lignocellulosic pulp stock which is conveyed into a statonary cylindrical drum and propelled in a linear direction therein in a pulsating fashion by a co-axial rotor comprising a plurality of impeller wings having a leading face and a trailing face, which attack the pulp stock at an angle in a wedging action as it is pushed ahead by the leading faces of the impellers to induce in the pulp stock internal frictional shear forces while it is being forced through a gap clearance defined between the free ends of the impeller wings and a series of spaced shear members arranged axially along the interior wall surface of the drum, the improvement in which said shear members comprise staves having a substantially rectangular cross section and being detachably mounted in slots in the wall of said drum so as to provide for variations in the gap clearance and additionally comprising a plurality of plow members adjustably mounted in the wall of said drum and accommodated in recesses in said impeller wings to permit the latter to pass said plow member during rotation to thereby regulate the flow of pulp stock through the gap clearance.

2. A drum refiner according to claim 1, in which said rectangular staves are additionally adjustable to provide for rotation of the faces thereof.

* * * * *